United States Patent [19]

Pollack

[11] Patent Number: 4,612,848

[45] Date of Patent: Sep. 23, 1986

[54] METHOD AND APPARATUS FOR MOVING AIR ACROSS A MINERAL FACE

[75] Inventor: Frank Pollack, Clarksburg, Pa.

[73] Assignee: Advanced Air Systems, Clarksburg, Pa.

[21] Appl. No.: 742,697

[22] Filed: Jun. 7, 1985

[51] Int. Cl.[4] ..... E21F 17/12

[52] U.S. Cl. ..... 98/50; 52/645; 182/47; 182/159

[58] Field of Search ..... 182/159, 160, 129, 47; 52/645, 641; 98/50; 135/11

[56] References Cited

U.S. PATENT DOCUMENTS

| | | | |
|---|---|---|---|
| 3,863,554 | 2/1975 | Boyd | 98/50 |
| 4,282,802 | 8/1981 | Divers | 98/50 |
| 4,463,829 | 8/1984 | Grin | 182/160 |

FOREIGN PATENT DOCUMENTS

| | | | |
|---|---|---|---|
| 344798 | 3/1931 | United Kingdom | 135/111 |

*Primary Examiner*—Larry I. Schwartz

*Attorney, Agent, or Firm*—Lawrence R. Burns

[57] ABSTRACT

A compact, collapsible and automatically expansible mining canvas is constructed and arranged so that a mine worker may stand under a supported roof section and extend into a newly sumped coal portion a forward section of a mining canvas so as to direct the air flow across the face of a newly mined coal section so as to remove any dangerous gasses and debris escaping therefrom. The mining canvas comprises an upper support and a lower support connected by pivotal intermediate support members and a canvas which is connected there between and which is preferably pleated so as to allow collapsible and expansible operation. Included in this invention is the method by which a miner may stand under an already supported section and extend to within a few feet of the newly mined or sumped face a compact, collapsed but expansible canvas section that is easily transportable to the face and which upon expansion will engage the roof and floor of the mine so as to direct the air flow against the face.

15 Claims, 8 Drawing Figures

METHOD AND APPARATUS FOR MOVING AIR ACROSS A MINERAL FACE

BACKGROUND OF THE INVENTION

This invention has to do with a frame and canvas arrangement for directing airflow across a newly mined face during mining operations and is especially concerned with coal mining operations where a steady stream of air or other fluids is necessary to maintain safety conditions in the mining operation.

During mining operations such as coal mining it is mandatory to maintain a certain level of safety conditions in order to prevent injury to the miners. Two items that contribute greatly to the safety of the miner are: (1) ventilation and dust control and (2) roof control.

Ventilation and dust control are necessary because of the gasses and other debris such as dust that are released from the newly mined mineral face. Other gasses or impurities in the air may result from blasting operations in a mine, oxidation of the coal, or decay of vegetable matter such as timber. Gasses usually found in coal mines are chiefly oxygen, nitrogen, carbon dioxide, methane and sometimes carbon monoxide, hydrogen, and hydrogen sulfide. These gasses are diluted to non harmful concentrates and removed from the mine by an efficient ventilation and control system.

It is the mine face that these gasses are especially released and two items causing concern are the creation of dust and the release of methane. Dust and methane in the right concentrations can cause explosions and fires. Extreme safety conditions must prevail with these items.

In order to create a fire or explosion there must exist three essential factors: (1) a combustible material, (2) sufficient oxygen and (3) a source of ignition. Coal dust, methane and other gasses usually provide the combustible material at the face. Oxygen is provided by air circulation and the source of ignition can be many things such as the striking of the coal machinery against rock or other debris in the coal seam, or electrical arcing of the machinery controls.

Since all three of the items necessary for disaster are necessarily present at the mine face it is known that control of the concentration of the combustible material can prevent fire or explosions. Diluting the methane gas released and suppressing the coal dust are two very effective methods.

It is reported for methane to be explosive it may be in the range of 5 to 15% in an atmosphere containing sufficient amounts of oxygen.

A mixture of normal mine air containing nominal amounts of oxygen and a 5% mixture of methane can cause a rather slow explosion whereas when the mixture of methane is about 9.5% the resulting explosion or oxidation as that of the 5% methane mixture may again occur. When the atmosphere around the mine face contains more than 15% methane an explosion will probably not occur, but also any miner in such an atmosphere will have insufficient oxygen to breathe. For these reasons the methane at the coal or mineral face should be detected immediately and removed or diluted by air so as to preserve safety conditions.

Practically all dusts that are composed of carbonaceous materials are explosive. The explosion of such dusts is similiar to the burning of many small particles of dust at the same time. It is thought that the condition of dust explosions are similiar to the condition of methane explosions as described above. For this reason dust concentrations must be removed or diluted in order to preserve safety conditions.

Another important factor for safety conditions in a mine is roof support. It is reported that falls or roof account for over 50% of the fatalities that occur in coal mines in the United States.

The roof of a mine is supported by artificial means or natural means. Natural means may consist of a STRATA above the immediate coal bed roof that forms the overburden to the surface. Artificial means may include structural supports including roof bolting of the ceiling of the mine after a section or pillar has been sumped.

One of the popular methods of mining in the United States is in the use of a continuous mining machine that removes coal or minerals in the pillar method of mining. In order to perform this method of mining it is necessary to remove coal from its formation several feet forward from a supported roof condition. After removal of the coal formation the roof over the "several feet" removed is in an unsupported condition. It is important that the new coal face has air directed at it so as to remove the conditions that may cause danger to a miner and that the unsupported roof now be artifically supported. In roof bolting or other artificially supported roof conditions this means that air or other fluids must be directed to the newly mined face or materials so as to prevent the buildup of gasses or dust that might cause an explosion. In order to do this someone must extend the already existing structure of directing air underneath the naturally supported roof, or particular artifically supported roof so as to remove or dilute the gasses or dust that might be collecting.

The already existing structure for directing air to the mine face usually consists of vertical posts placed in position along the mine passageway with a temporary canvas structure strung along the posts. The canvas is one selected and/or approved by the Bureau of Mines.

Because of the importance of the already described (1) ventilation and dust control and the (2) roof control; it is important that the temporary canvas structure be extended into a newly mined section as quickly as possible after the removal of the mining machinery. The closer the air can be directed to the new face the more efficient and safer the mining operation will be. Under the existing systems a miner must trust the strata of the mine roof to support the roof until artificial supports such as roof bolts can be installed. Usually this means that the miner must enter the newly unsupported roof section to place the canvas posts and canvas so as to direct air against the face.

BRIEF SUMMARY OF THE INVENTION

This invention has to do with a frame and canvas arrangement in which said frame comprises an upper canvas support with abutment means for engagement with the roof of a coal mine. A lower canvas support means is provided with additional abutment means for a mine floor and pivotal support members connect the upper and lower support means in a collapsible manner so that when released the upper support of the canvas automatically abuts the surface of the mine and the lower surface of the canvas automatically abuts the lower surface of the mine. Two of these canvas sections may be easily transported to a newly sumped section of the mine and while the miner is standing in a supported roof section, each of these canvas arrangements may be extended into within a few feet of the mineral mine face and expanded so that air may be directed across the mineral mine face. The canvas arrangement preferably also has a pivot means holding the upper and lower canvas supports in substantially parallel relationship. Preferably the canvas is pleated in a manner so that the canvas arrangement can be expanded and collapsed without stretching or tearing the canvas fabric. The pleating arrangement is preferably a reversed pleat with one pleating pattern being formed along the upper canvas support means and exactly the reverse of that pleating pattern being attached connected along the bottom canvas support means. The preferred arrangement also has a hook means for holding the expansible arrangement in a collapsed position so as to be easily transported to a mine face. The canvas arrangement also preferably has on said lower canvas support means a bendable section so that when the canvas is collapsed the front end of the lower support is bent up in a ski fashion. The canvas arrangement can then be slid along the bottom of the mine floor and into place before allowing it to expand to abut the mine roof. Spring picks are located on the upper support member so as to engage the mine roof preferably along or in groves already formed by mining bits that have sumped out the new section of the mine.

DETAILED DESCRIPTION OF THE INVENTION

Figure 1:
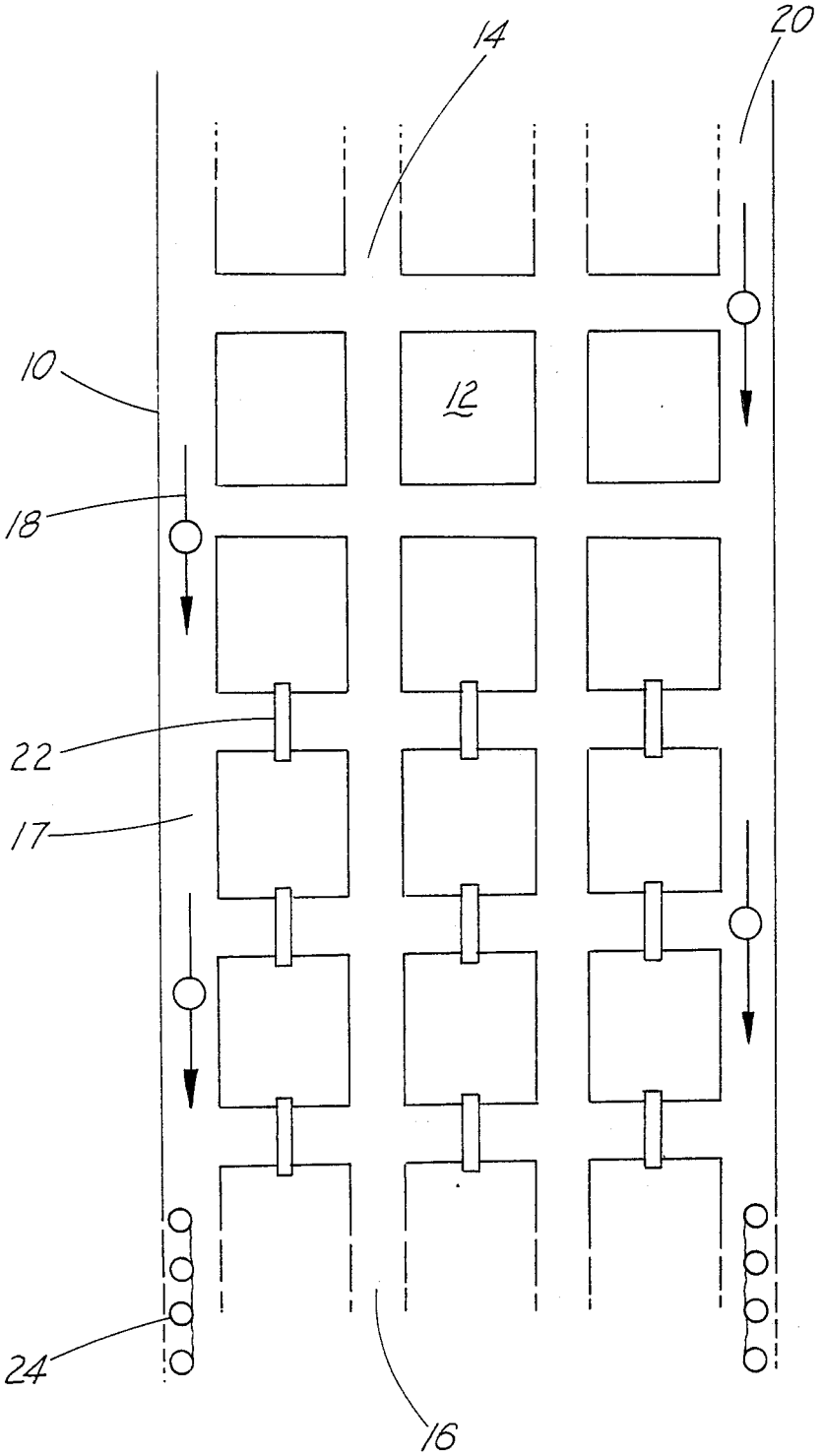
FIG. 1 is a plan view of a mine tunnel
Figure 2:
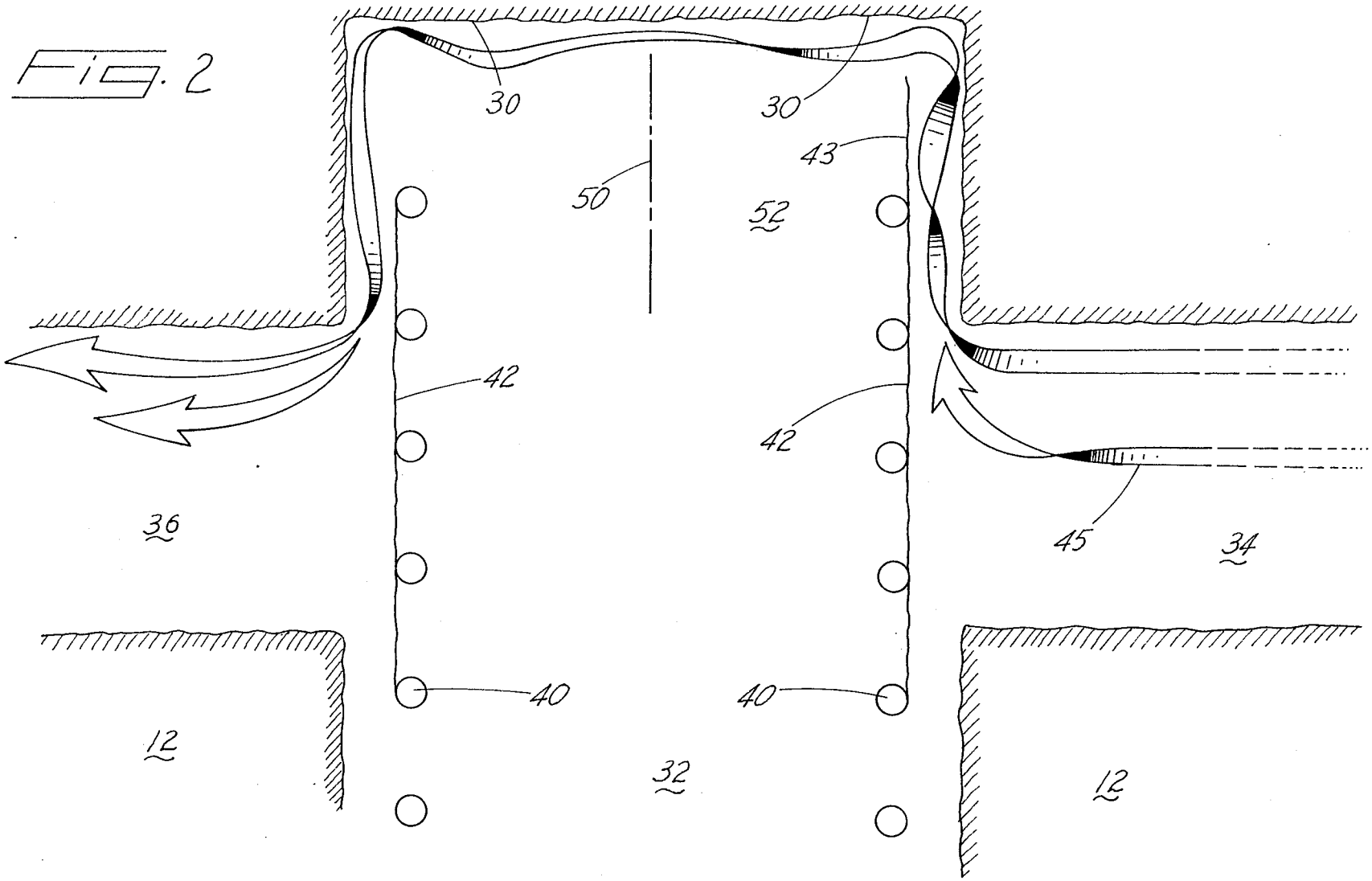
FIG. 2 is a plan view of a newly created mine face
Figure 3:
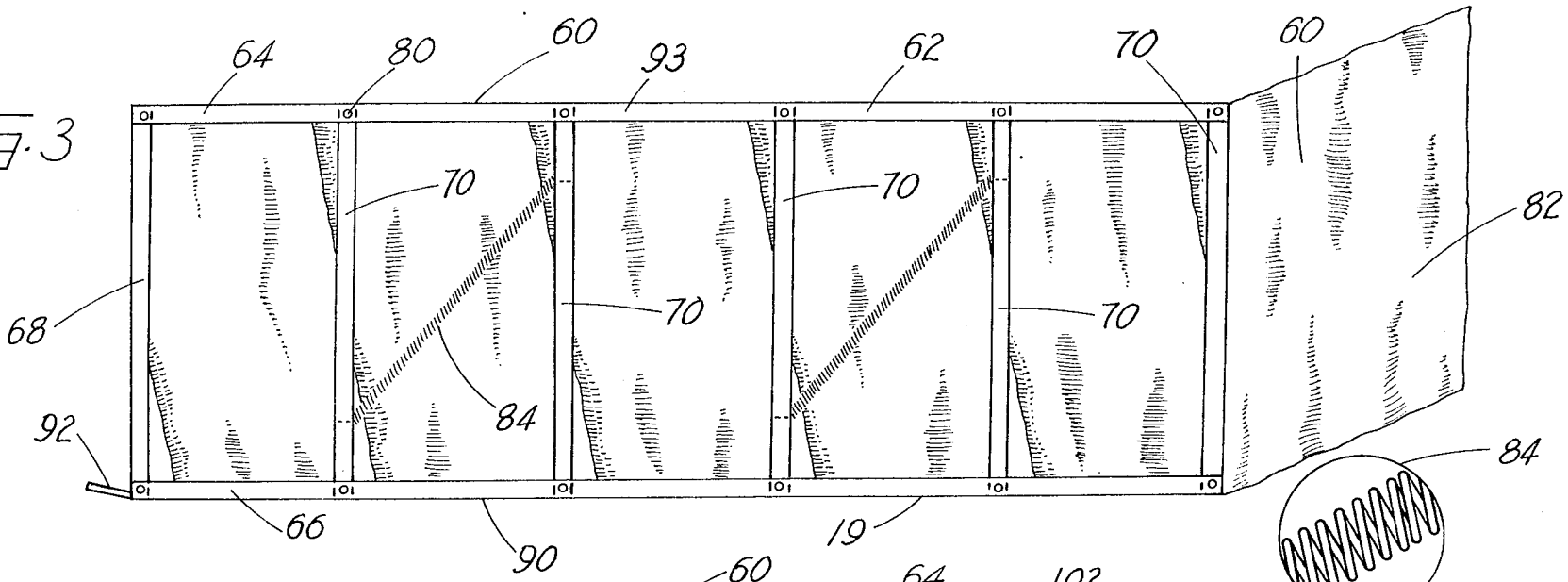
FIG. 3 is a side view of a canvas and frame arrangement according to the present invention
Figure 3A:
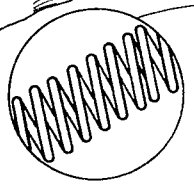
FIG. 3A is an enlarged view of expansible means 84
Figure 4:
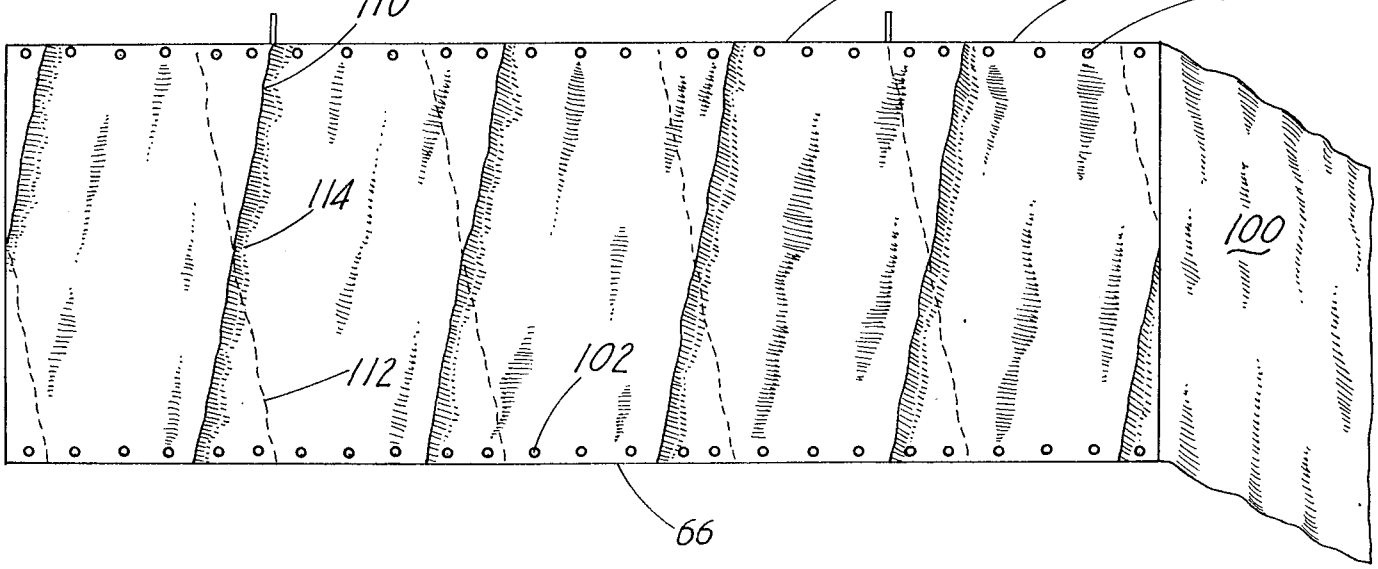
FIG. 4 is a side view of a canvas and frame arrangement according to the present invention

What is shown in FIG. 1 is a plan view of mine arrangement 10 having pillars 12 and air passages 14 constructed therein. The mine arrangement 10 has an air entry end 20 which conducts fresh air along air passage ways 14 towards an end 16 so as to continuously sweep away any dangerous gasses in the mine, and to dilute any gasses escaping from the newly mined mineral face. End 16 is shown as the end of air passage 14 that is directed towards the newly mined mineral face and the arrows, such as 18, indicate the direction of air flow to and away from the newly mined mineral face area 16. Once the air passages 14 and the pillars 12 have been formed it can be seen that permanent walls 22 may be constructed between the pillars 12 so as to direct the air along air passages 18 towards the mineral face area 16, and return it with the dangerous gasses or other substances along air passage 14. Usually the permanent walls 22 are put up using cinder block or other permanent construction materials. Besides the cinder block or permanent construction shown at 22, when one nears the mineral face area 16, canvas arrangements are placed along posts 24 so as to direct air against the mineral face 16. When these posts are placed in the mine they extend from the floor to the ceiling and canvas arrangements are attached to the posts. What is shown in FIG. 2 is a plan view of a detailed section of a newly mined mineral face 30. As can be seen, the pillars 12 exist forming an air passage 32 and also air passages 34 and 36. On this particular arrangement the mining posts 40 are shown extending along the passageway 32 and in the normal sequence of the events a canvas arrangement 42 will be hung along the posts on both sides of the air passageways 32. With this done, the air as shown in 45 may then come down the passageway 34 and it is then directed against the newly mined face 30. The air will sweep around and across until it exits along the air passage way 36. This is just one of many arrangements that may take place at the mining face 30. What must be done that as the new mineral face 30 is formed, preferably in two sections as it is shown by the dividing line 50, is that once a second section say at 52 has been sumped the mine personnel are standing below an unsupported section of the mine roof. Usually in cases like this, such as in coal mines, roof bolters will pass and place roof bolts upwardly in the mine roof so as to support it. Before this can be done, however, the canvas 43 should be extended inwardly toward the mine face 30. At this point the mining personnel face extreme risk due to the face that they are working around or near an unsupported mining roof. What is shown in FIG. 3 is a frame and canvas assembly 60 according to the present invention. The arrangement has a frame 62. The frame 62 has an upper canvas support member 64 and a lower canvas support means 66. The frame and canvas arrangement 60 also has a front end 68 and a rear end 70. Wherein the rear end 70 is used to control movement of the front end 68 towards the nearest part of the newly mined coal face 30. The pivotal support member 70 connects the upper canvas support means 64 with the lower canvas support means 66 in such a manner that the upper canvas support 64 and 66 are held in a spaced apart relationship with one another. The pivotal support members 70 are pivotally connected as at 80 so that the upper canvas support means 64 may be collapsed until it is almost adjacent to the lower support members 66. Shown at the rear end 70 of the frame and canvas assembly 60 is a flap 82 that may be used to connect onto the already existing canvas structure that approaches the newly sumped section 16 or face 30. A flap member 82 may be hooked onto it after the frame and canvas assembly 60 has been put in place so that the air will be directed upon and against the newly mined mineral face 30. Preferably, the frame and canvas assembly 60 has expansible means 84 connected between the pivotal support members 70 so that when the frame and canvas assembly 60 is in its natural and free state the members 84 urge this frame and canvas assembly into an expanded position as is shown in FIG. 3. The lower canvas support means 66 has along its bottom abutment means 19 for engagement with the mining tunnel floor and has on its front end a ski means 92 so that when the frame of the canvas assembly 60 is in its collapsed position that it may be slid along the mining tunnel floor until its desired position. Besides the ski means 92 as will be shown later there is a natural ski means around the front part of the lower canvas assembly 66 that is caused by it being bent upwardly when the frame and canvas assembly is at its collapsed position. Shown in FIG. 3A is an exploded view of the expansible means 84 which in this case is a spring means. Also in addition to the upper canvas support means 64 there is also a roof abutment means 93 so that when a frame and canvas assembly 60 is allowed to expand the lower canvas means 66 will abut the mine roof floor along its surface and the upper canvas support means 64 will abut the upper mine roof with abutment means 93. Also included in the invention is the fact that sealing means may interposed along both abutment surfaces 90 and 93 so as to prevent any air from escaping or passing through to the canvas arrangement from one side to the other. Shown in FIG. 4 is a frame and canvas assembly 60 having a canvas 100 (which is any approved canvas as set out by the bureau of mines or any other authority having to do with the mining operation). The canvas 100 is shown connected along the upper canvas support means 64 with fastners 102 connecting the canvas 100 to the upper canvas support means 64. Shown also along the bottom is the canvas 100 connected to the lower canvas support 66 again by fastners 102. The frame and canvas assembly 60 is shown in its full extended position with the canvas 100 being shown in a pleated condition as is shown by pleats 110 and 112 this being a common example of the pleating on this frame and canvas assembly 60. The pleating arrangement occurs around the pivotal structural support member 70 and is preferably overlaped by and having a 5 inch fold covered by a 12 inch lap going the other way. It is preferable that the pleats shown at 110 be exactly the reverse of the pleat shown at 112 so that the frame and canvas assembly 60 can be collapsed without ripping or distorting the canvas 100. With the pleating arrangements shown at 110 and 112 one can see the folds 114 that will occur along the frame and canvas assembly 60. Preferably when the frame and canvas assembly 60 are used the air flow will be along the outer section of the canvas 100 rather than the inner structural section as is shown by the side view of FIG. 3.

Figure 5:
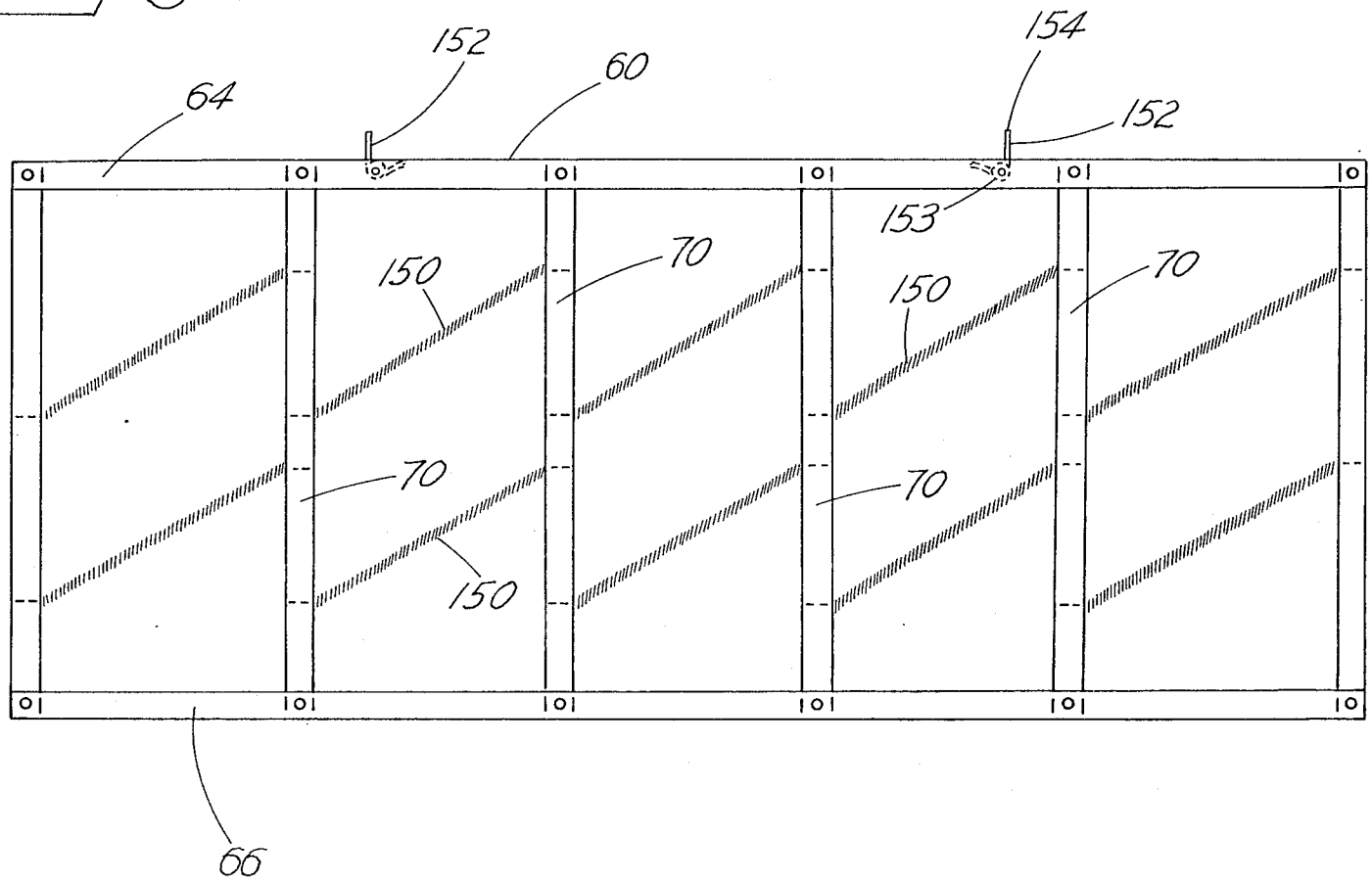
FIG. 5 is a side view of an alternate canvas and frame arrangement according to the present invention
Figure 7:
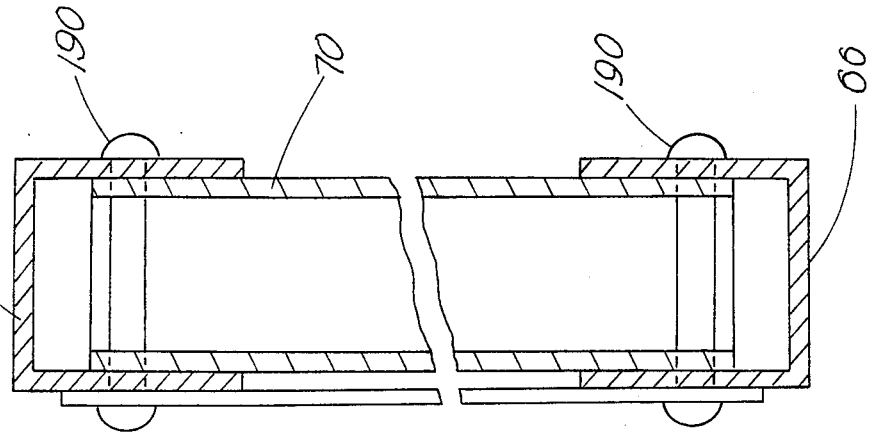
FIG. 7 is a sectional view of the canvas and frame arrangement according to the present invention
Figure 6:
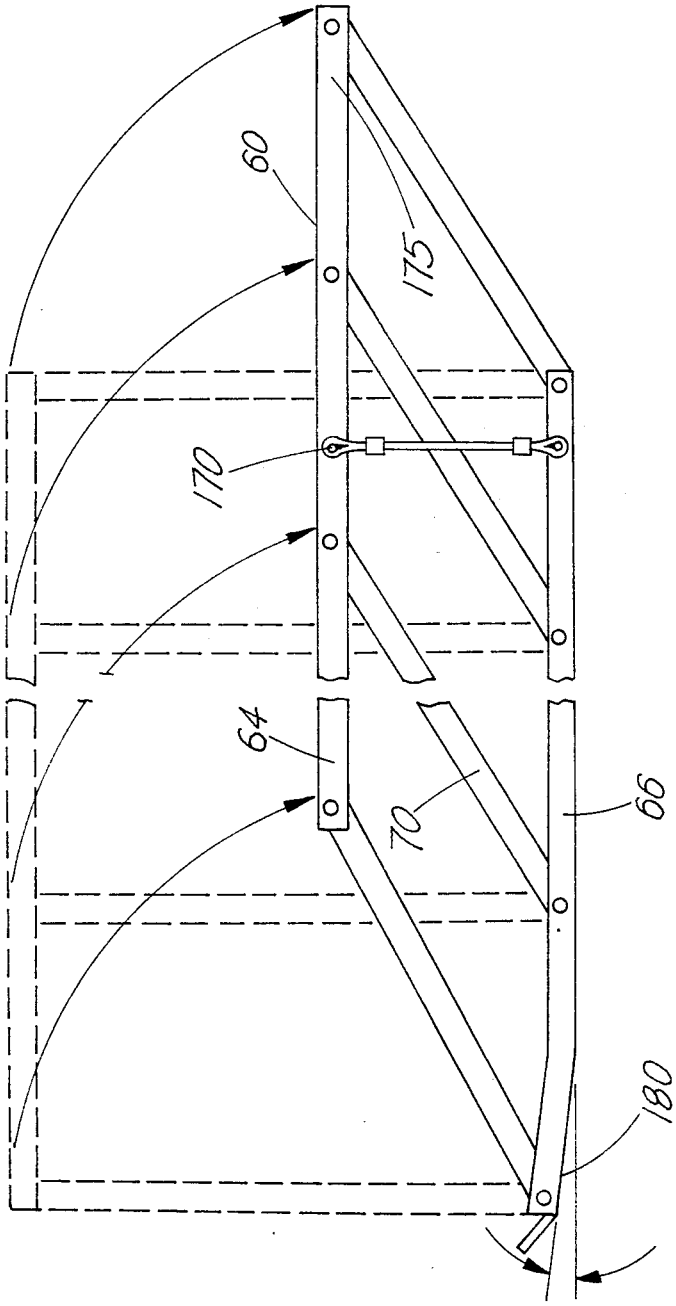
FIG. 6 is a side view of the frame and canvas assembly in its collapsed position

Shown in FIG. 5 is another arrangement of the frame and canvas assembly 60 this time showing the expansible means 150 connected between the pivotal support means members 70. In this case the spring means providing the expansible means 150 are shown in an alternate mode with two spring means 150 connected between each of the pivotal support members 70. Shown on this frame also is the spring loaded assembly 152 that is mounted on the upper canvas support means 64 being shown as a coiled spring member 153 with an upper extending member 154. These are used to engage the grooves in the mine roof and so as to secure the frame and canvas assembly 60 in position once expanded. What is shown in FIG. 6 is the frame and canvas assembly 60 in its collapsed position with the lower canvas supports 66 and the upper canvas support 64 being squeezed toward one another and held together by hook and cable means 170. The pivotal support member 70 is shown now at other than right angles to the upper canvas support 64 and the lower canvas support 66. On the rear end of the frame and canvas assembly 60 is shown the end 175 where it is desired that the miner may manually grab the end 175 while the frame and canvas assembly 60 is in a collapsed position and slide it toward the newly mined mineral face. Because of the ski means 92 shown in FIG. 3 and because of the natural ski means 180 that occurs when the spaced apart canvas support means 64 and 66 are collapsed together the front end of the lower canvas support means 66 is bent upwardly and this aids in sliding along the mining floor. Shown in FIG. 7 is a cross sectional view showing the simplicity of the construction of the upper canvas support means 64 and lower canvas support means 66 interconnected with the pivotal support member 70. The members 64 and 66 can be constructed out of inch to and inch and quarter aluminum channel iron with the pivotal support number 70 being formed out of inch to inch and quarter aluminum box channel material. The rivets or connecting means 190 shows the pivotal connection between the members. With this type of construction the entire assembly will be light enough to transport to the mine face and placed in position by a single miner without having the miner enter into any section of the mine where there is an unsupported roof.

While the invention has been described in detail for a preferred embodiment, it will be understood that modifications may be made without departing from the scope of the invention.

What is claimed is:

1. A collapsible, expansible frame and canvas arrangement which comprises:

a. a frame, said frame having a front end for movement towards a mine face;

b. a rear end for controlling movement of said front end towards said mine face and;

c. an upper canvas support means extending between said front and rear ends of said frame d. lower canvas support means on said frame e. support members pivotally connected between said upper and lower support means so that said frame has a collapsed configuration and an expanded configuration f. abutment surfaces on said frame for abutment with a mine floor and a mine roof g. expansible means on said frame urging said upper canvas support means from a collapsed position into a spaced apart relationship with said lower canvas support and said abutment surfaces into engagement with the mine floor and roof when said frame is in the expanded position and;

h. means for holding said frame in a collapsed configuration i. canvas means connected between said upper support and said lower support so as to direct air flow from one end of said frame to the other when in an expanded configuration.

2. The canvas arrangement according to claim 1 which further comprises:

said pivotal support members holding said upper and lower canvas support means in a substantial parallel relationship in said spaced apart relationship.

3. The canvas arrangement according to claim 2 which further comprises:

said canvas means attached to said upper support in a pleated manner and attached to said lower support in a pleated manner.

4. The canvas arrangement according to claim 3 which further comprises:

said pleating pattern on said upper canvas support means being a reversed pattern from the pleating pattern on the lower canvas support means when viewed from the side.

5. The canvas arrangement according to claim 4 which further comprises:

cable and hook means for holding said expansible arrangement in a collapsed position so as to be transported.

6. The canvas arrangement according to claim 1 which further comprises:

means on said upper support for a person to manually cause the collapse of said arrangement.

7. The canvas arrangement according to claim 6 which further comprises:

raised ski means on said front end, for facilitating movement of said front end toward said mine face, said ski means being present when said arrangement is partially collapsed.

8. The canvas arrangement according to claim 2 in which said pivotal support members comprise multiple intermediate members connected between said upper and lower support means, each individual intermediate member pivotably connected to said upper and lower support members.

9. The canvas arrangement according to claim 8 in which said expansible means urging said upper canvas support into a spaced apart relationship with said lower support means comprises spring means connected between individual intermediate members so as to urge the upper and lower supports into a spaced apart relationship.

10. The canvas arrangement according to claim 1 which further comprises ski means on said front end for facilitating movement of the lowermost frame member along the mine floor.

11. The canvas arrangement according to claim 11 in which said ski means comprises an upwardly bent member attaching to the front end of said lower canvas support means.

12. The method of extending air flow to a mineral mining face that comprises the steps of:

a. transporting a collapsed mining canvas that has canvas attached to an upper and lower support structure.

b. extending a forward end of the collapsed mine canvas arrangement to within a few feet of the mineral mining face while standing under a supported roof section.

c. releasing the collapsed mine canvas arrangement so that it automatically expands to engage the floor and the roof of the sumped mine section.

d. placing such expansible but collapsible arrangements so as to allow air flow to efficiently flow across the newly mined face so as to remove the dangerous gasses and debris escaping therefrom.

13. The method according to claim 12 in which the mineral mining face is a coal mining face.

14. A collapsible, expansible frame and canvas arrangement which comprises:

a. a frame, said frame having a front end for movement toward a mine face;

b. a rear end for controlling movement of said front end toward a mine face; and c. said frame having an upper canvas support means extending between said front and rear ends of said frame;

d. said frame having lower canvas support means on said frame;

e. said frame having support members pivotally connected between said upper and lower canvas support means so that said upper and lower support means are held in a spaced apart and substantially parallel relationship, said pivotal members providing said frame with a collapsed configuration and an expanded configuration;

f. an abutment surface on said frame for abutment with a mine floor and another abutment surface on said frame for abutment with a mine roof, said mine roof abutment surface comprising spring picks on said upper canvas support means to engage the mine roof and secure said frame and canvas arrangement in its location;

g. expansible means on said frame urging said upper canvas support means into said spaced apart relationship with said lower canvas support and said abutment surfaces into engagement with the mine floor and mine roof when said frame is in the expanded position; and h. means for holding said frame in a collapsed configuration;

i. canvas means connected between said upper support and said lower support so as to direct air flow from one end of said frame to the other when in an expanded configuration.

15. A collapsible, expansible frame and canvas arrangement which comprises:

a. a frame, said frame having a front end for movement toward a mine face;

b. a rear end for controlling movement of said front end toward said mine face; and c. an upper canvas support means extending between said front and rear ends of said frame;

d. lower canvas support means on said frame;

e. support members pivotally connected between said upper and lower support means so that said frame has a collapsed configuration and an expanded configuration, said pivotal support members holding said upper and lower canvas support means in a substantial parallel and spaced apart relationship with one another; said pivotal support members comprising multiple intermediate members connected between said upper and lower support means, each individual intermediate member pivotally connected to said upper and lower support members;

f. abutment surfaces on said frame for abutment with a mine floor and a mine roof;

g. expansible means on said frame urging said upper canvas support means into said spaced apart relationship with said lower canvas support and said abutment surfaces into engagement with the mine floor and roof when said frame is in the expanded position, said expansible means urging said upper canvas support into a spaced apart relationship with said lower support means and comprising spring means connected between individual intermediate members so as to urge the upper and lower supports into a spaced apart relationship, said spring means having springs attached between successive intermediate members with the springs attached nearest the end having means for collapsing said arrangement located higher on the intermediate member than the next successive intermediate member to which the spring connects;

h. means for holding said frame in a collapsed configuration.

i. canvas means connected between said upper support and said lower support so as to direct air flor from one end of said frame to the other when in an expanded configuration.

* * * * *